United States Patent [19]

Kato et al.

[11] Patent Number: 5,069,187

[45] Date of Patent: Dec. 3, 1991

[54] FUEL SUPPLY CONTROL SYSTEM FOR INTERNAL COMBUSTION ENGINES

[75] Inventors: Akira Kato; Takafumi Nishikawa; Shun Masuda, all of Wako, Japan

[73] Assignee: Honda Giken Kogyo K.K., Tokyo, Japan

[21] Appl. No.: 575,080

[22] Filed: Aug. 30, 1990

[30] Foreign Application Priority Data

Sep. 5, 1989 [JP] Japan ..... 1-104472[U]
Sep. 11, 1989 [JP] Japan ..... 1-107118[U]

[51] Int. Cl.[5] ..... F02M 51/00

[52] U.S. Cl. ..... 173/492; 123/480; 123/494

[58] Field of Search ..... 123/492, 493, 494, 480

[56] References Cited

U.S. PATENT DOCUMENTS 4,884,548 12/1989 Sogawa ..... 123/492
4,889,100 12/1989 Nakaniwa et al. ..... 123/492
4,911,131 3/1990 Nakaniwa et al. ..... 123/492
4,919,100 4/1990 Nakamura ..... 123/492
4,928,654 5/1990 Hosaka ..... 123/492
4,951,635 8/1990 Nakaniwa et al. ..... 123/493
4,957,088 9/1990 Hosaka ..... 123/480
4,960,097 10/1990 Tachibana et al. ..... 123/494
4,966,118 10/1990 Itakura et al. ..... 123/492

*Primary Examiner*—Raymond A. Nelli
*Attorney, Agent, or Firm*—Arthur L. Lessler

[57] ABSTRACT

A fuel supply control system for an internal combustion engine having an intake pipe, and a throttle valve arranged in the intake pipe. A basic value of a fuel amount to be supplied to the engine is determined based on a load on the engine. The determined basic value of the fuel amount is corrected by a correction value for increasing the fuel amount during and/or after acceleration of the engine. The correction value is determined based on a change in the opening degree of the throttle valve. The correction valve is further determined based on a change in the magnitude of the load on the engine.

12 Claims, 12 Drawing Sheets

FUEL SUPPLY CONTROL SYSTEM FOR INTERNAL COMBUSTION ENGINES

BACKGROUND OF THE INVENTION

This invention relates to a fuel supply control system for internal combustion engines, and more particularly to a system of this kind which is adapted to properly control the air-fuel ratio of a mixture of fuel supplied to the engine, during and immediately after acceleration of the engine.

There is generally known a fuel supply control method for internal combustion engines, which utilizes electronic means to subject a basic value Ti of the fuel injection period, which is determined from the engine rotational speed and absolute pressure within the engine intake pipe, to multiplication and/or addition by correction values and/or correction coefficients determined from engine operating parameters, such as the engine rotational speed, the intake pipe absolute pressure, the engine coolant temperature, the throttle valve opening and the concentration of an ingredient (oxygen) contained in exhaust gases emitted from the engine, to thereby determine the valve opening period for fuel injection valves and hence control the air-fuel ratio of a mixture supplied to the engine.

In the generally known fuel supply control method, it is also known, e.g. from Japanese Provisional Patent Publication (Kokai) No. 60-3458, to add an accelerating fuel increment $T_{ACC}$ determined from a rate of change in the opening degree of the throttle valve to the basic value Ti of the fuel injection period at the beginning of acceleration of the engine, in order to improve the accelerability of the engine.

Further, in the generally known method, it is also known, e.g. from Japanese Provisional Patent Publication (kokai) No. 60-60234 to set the accelerating fuel increment $T_{ACC}$ in such a manner that it is first set in accordance with the rate of change in the opening degree of the throttle valve during acceleration of the engine, and progressively decreased at a predetermined rate immediately after the acceleration, thereby improving the accelerability, drivability, etc. of the engine.

According to the former method, however, immediately when the engine enters an accelerating state, the accelerating fuel increment $T_{ACC}$ is determined from various engine operating parameters, including not only the rate of change in the throttle valve opening degree, but also the engine rotational speed, and whether or not fuel cut was effected just before the acceleration. However, once the engine has entered the accelerating state, the accelerating fuel increment $T_{ACC}$ is determined solely from the rate of change in the throttle valve opening degree.

According to the latter method, on the other hand, the accelerating fuel increment $T_{ACC}$ is set such that it is progressively decreased at a predetermined rate independently of engine operating parameters, immediately after the acceleration of the engine.

Particularly, in the both methods, the accelerating fuel increment $T_{ACC}$ is set independently of the intake pipe absolute pressure, the amount of air supplied to the engine, and the basic value Ti of the fuel injection period.

This will be explained in details with reference to (*a*) to (*d*) of FIG. 8. When the throttle valve opening degree $\theta_{TH}$ is increased to demand acceleration of the engine, as shown in (*a*) of FIG. 8, the intake pipe absolute pressure $P_{BA}$ increases with a certain delay, so that the basic value Ti of fuel injection amount determined from the intake pipe absolute pressure $P_{BA}$ increases with delay, as shown in (*b*) of FIG. 8. Since the basic value Ti is usually set almost in proportion to the intake pipe absolute pressure $P_{BA}$, it increases along almost the same rise curve as that of the intake pipe absolute pressure $P_{BA}$.

In the known methods, on the other hand, the accelerating fuel increment $T_{ACC}$ is set such that it changes in accordance with the rate of change in the throttle valve opening degree, regardless of change in the basic value Ti of the fuel injection period shown in (*b*) of FIG. 8, as shown by the solid line in (*c*) of FIG. 8.

Therefore, the fuel injection period $T_{OUT}$ (hence the fuel injection amount), which is obtained by correcting the basic value Ti by adding the accelerating fuel increment $T_{ACC}$, changes as shown by the solid line in (*d*) of FIG. 8, whereby an excessive amount of fuel is supplied to the engine, with respect to an intake air amount $G_{air}$ actually supplied to the engine. More specifically, as the throttle valve opening degree $\theta_{TH}$ increases as shown by the solid line in (*a*) of FIG. 8, the intake air amount $G_{air}$ increases as shown in (*e*) of FIG. 8, so that the fuel amount supplied to the engine becomes excessive by an amount corresponding to the hatched area, resulting in degraded exhaust emission characteristics, degraded drivability, increased fuel consumption, etc.

SUMMARY OF THE INVENTION

It is the object of the invention to provide a fuel supply control system for internal combustion engines, which is capable of setting the accelerating fuel increment in accordance with a basic value of the fuel injection amount or load on the engine, so as to make the amount of fuel more appropriate to the amount of intake air supplied to the engine, thereby improving the exhaust emission characteristics, drivability, fuel consumption, etc.

To attain the above object, the present invention provides a fuel supply control system for an internal combustion engine having an intake pipe, and a throttle valve arranged in the intake pipe, wherein a basic value of a fuel amount to be supplied to the engine is determined based on a load on the engine, and the determined basic value of the fuel amount is corrected by a correction value for increasing the fuel amount during and/or after acceleration of the engine, the correction value being determined based on a change in the opening degree of the throttle valve.

The fuel supply control system according to the present invention is characterized by an improvement wherein the correction value is further determined based on a change in the magnitude of the load on the engine.

Preferably, the correction value is further determined based on a change in absolute pressure within the intake pipe.

The basic value of the fuel amount is determined based on absolute pressure within the intake pipe. Preferably, the correction value is further determined based on a change in the basic value of the fuel amount.

In a first preferred form, the system includes basic value determining means for determining a basic value of a fuel amount to be supplied to the engine, based on a load on the engine, acceleration determining means for detecting the opening degree of the throttle valve and determining whether or not the engine is in a predetermined accelerating condition, based on a change in the opening degree of the throttle valve, correction value determining means for determining a correction value for increasing the fuel amount, based on a change in the opening degree of the throttle valve when the acceleration determining means determines that the engine is in the predetermined accelerating condition, and basic value correcting means for correcting the basic value of the fuel amount by the correction value.

The fuel supply control system according to the first preferred form is characterized by an improvement comprising correction value decreasing means for decreasing the correction value with increase in the magnitude of the load on the engine.

Preferably, in the first preferred form, the correction value decreasing means decreases the correction value at a larger rate as a rate of increase in the load on the engine increases.

In a second preferred form, the system includes basic value determining means for determining a basic value of a fuel amount to be supplied to the engine, based on a load on the engine, acceleration determining means for detecting the opening degree of the throttle valve and determining whether the engine is in a predetermined accelerating condition or in a post-acceleration condition, based on a change in the opening degree of the throttle valve, correction value determining means for determining a correction value for increasing the fuel amount, based on a change in the opening degree of the throttle valve when the acceleration determining means determines that the engine is in the predetermined accelerating condition, and correction value decreasing means for progressively decreasing the correction value from a value thereof obtained immediately before termination of the predetermined accelerating condition when the acceleration determining means determines that the engine is in the post-acceleration condition, and basic value correction means for correcting the correction value determined by one of the correction value determining means and the correction value decreasing means.

The fuel supply control system according to the second preferred form is characterized by an improvement wherein the correction valve decreasing means progressively decreases the correction value at a rate set based on a change in the magnitude of the load on the engine.

Preferably, the correction value decreasing means progressively decreases the correction value at a larger rate as a rate of increase in the magnitude of the load on the engine.

The above and other objects, features, and advantages of the invention will be more apparent from the ensuing detailed description taken in conjunction with the accompanying drawings.

Figure 3A:
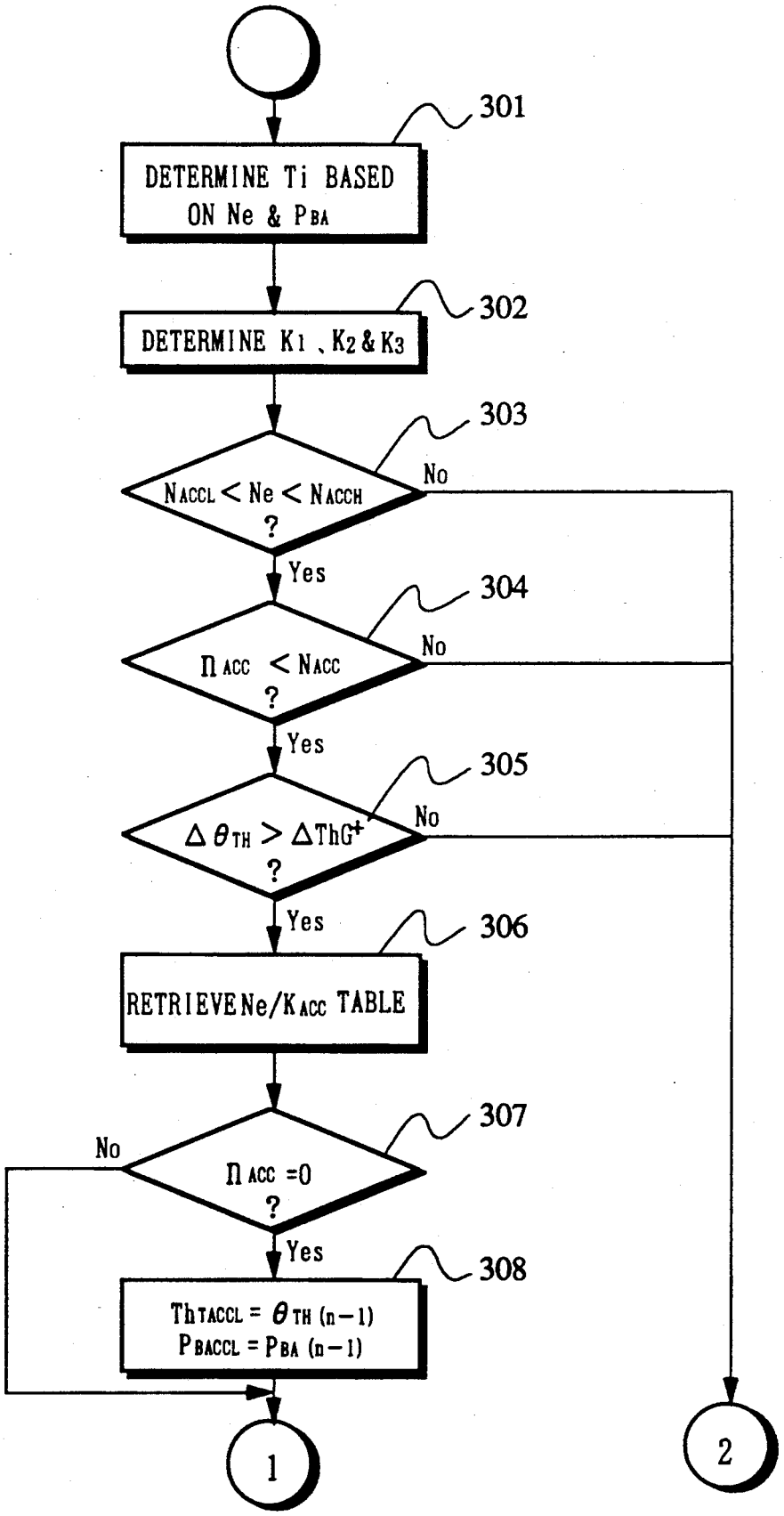
Figure 3B:
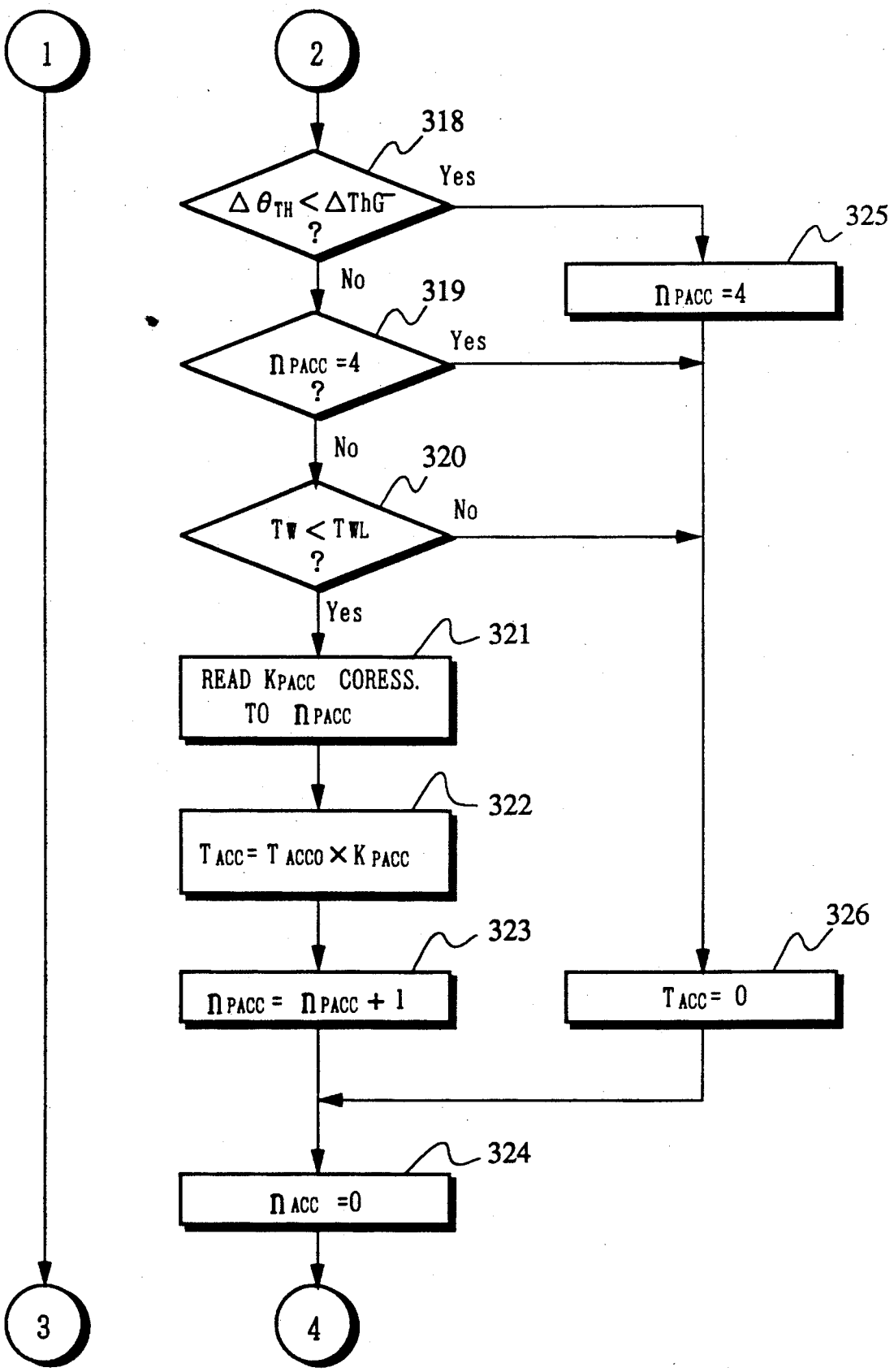
Figure 3C:
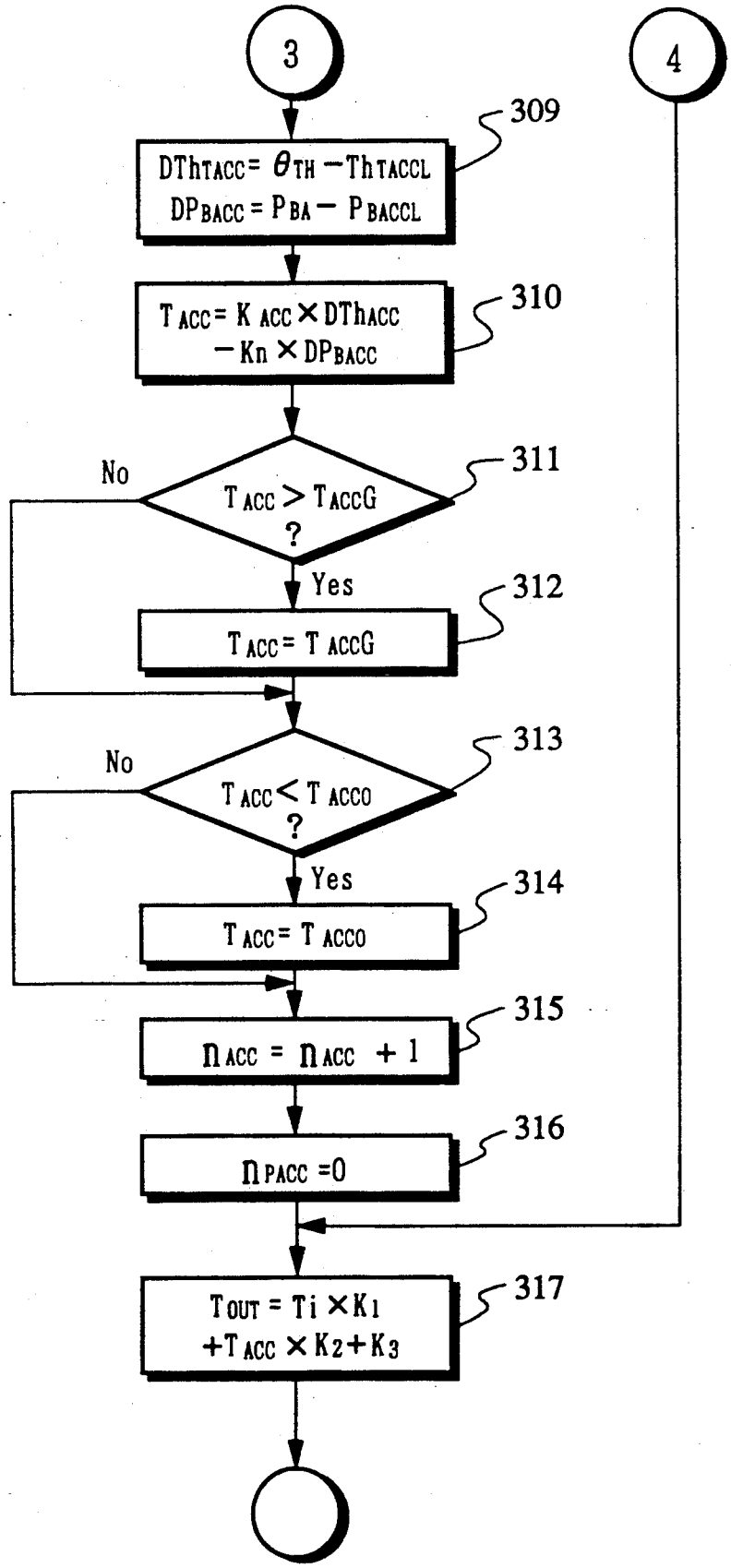
Figure 4:
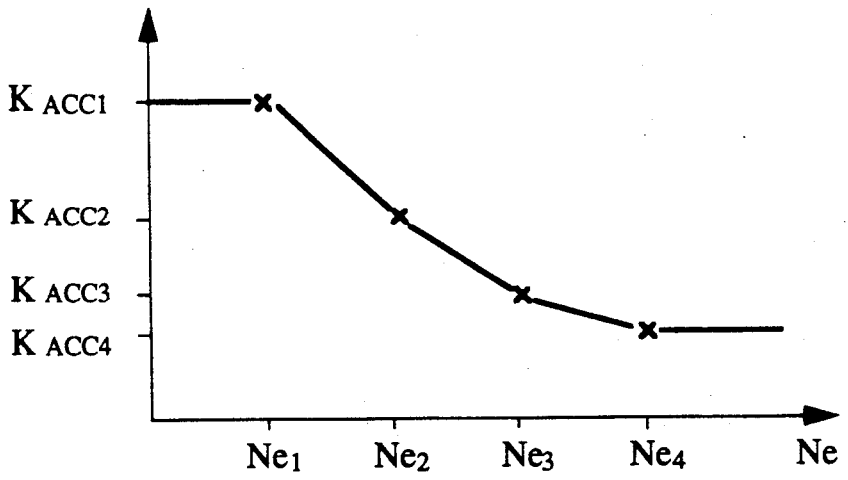
Figure 5A:
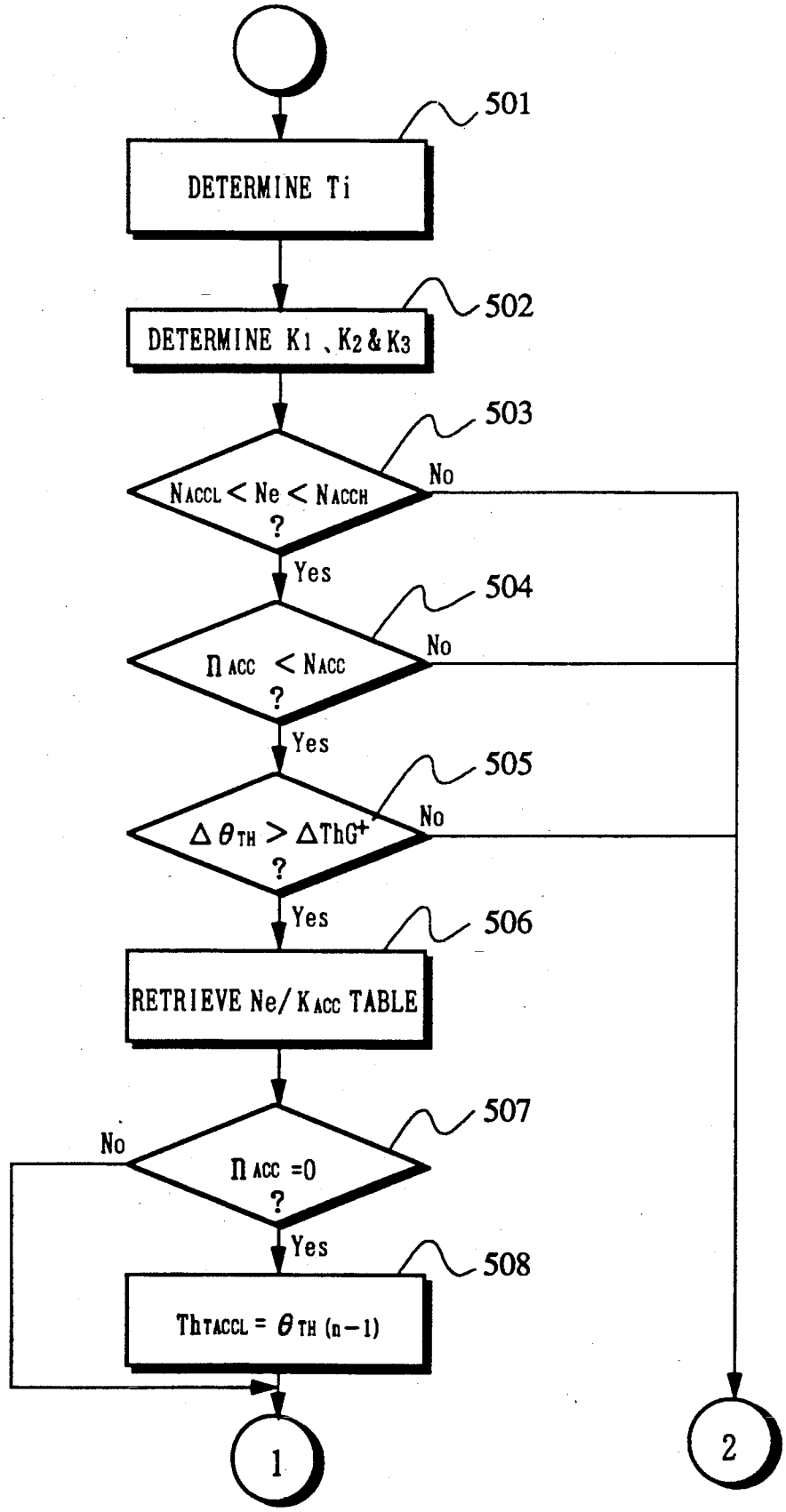
Figure 5B:
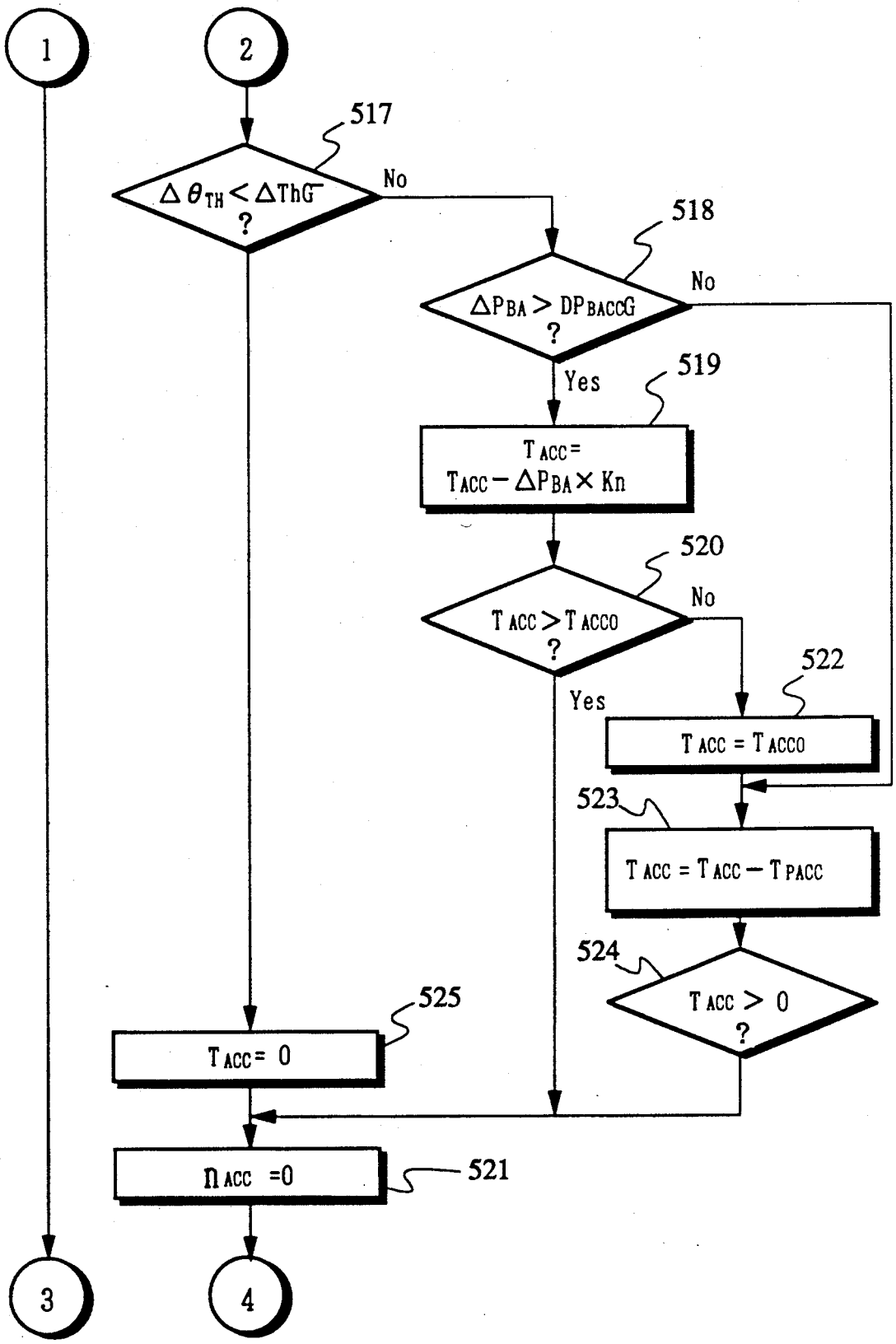
Figure 5C:
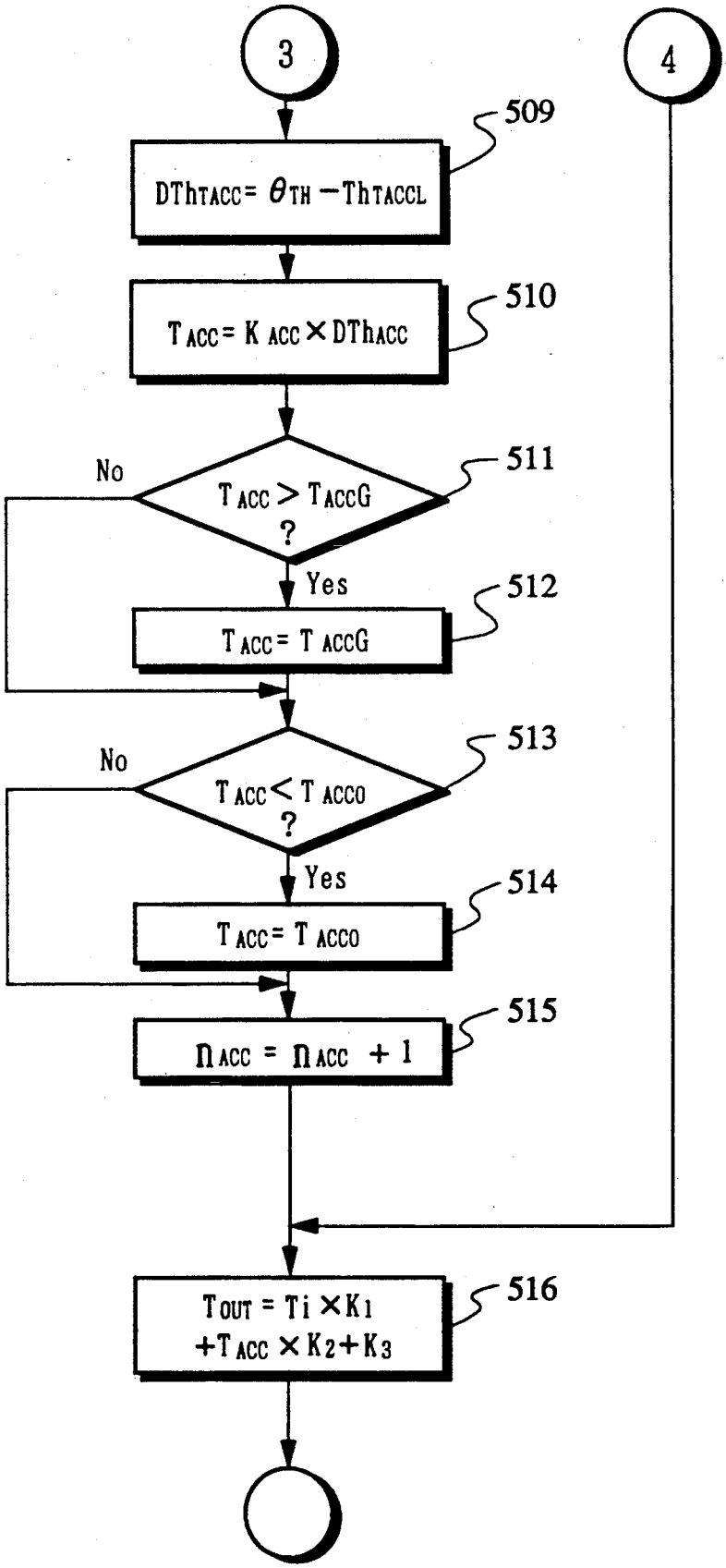
Figure 6:
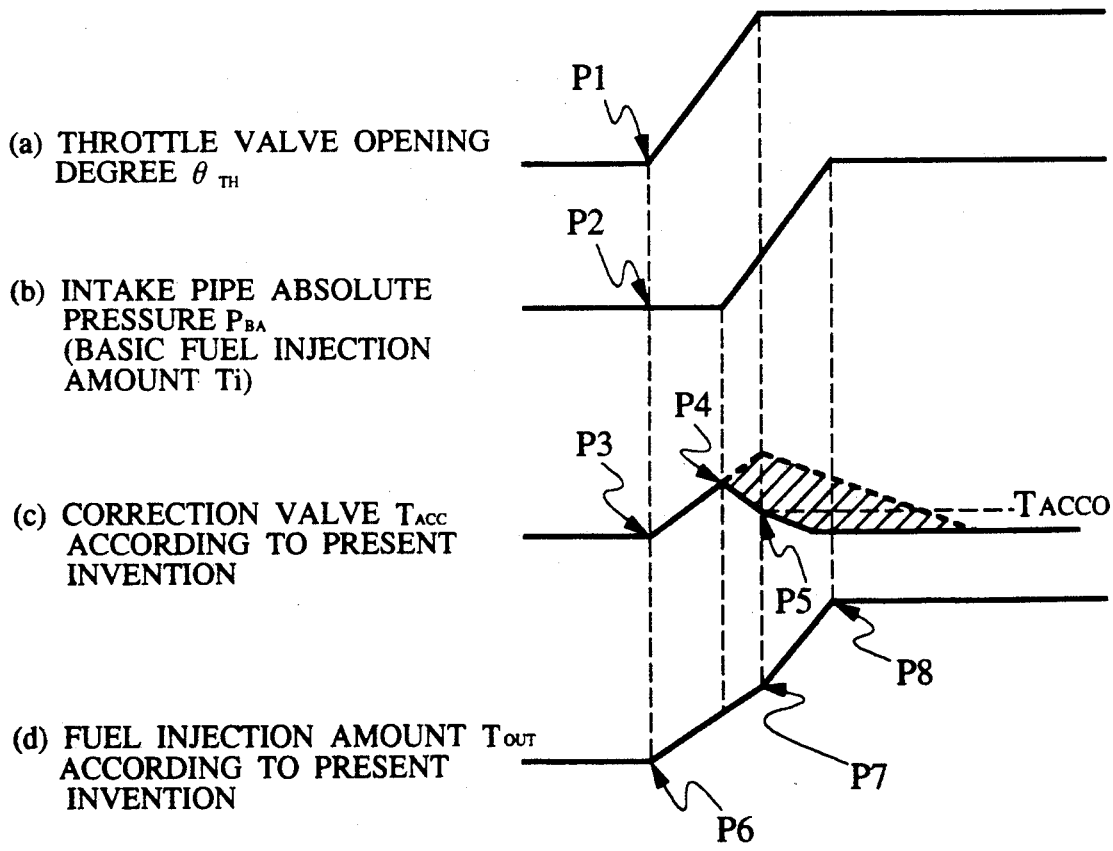
Figure 7:
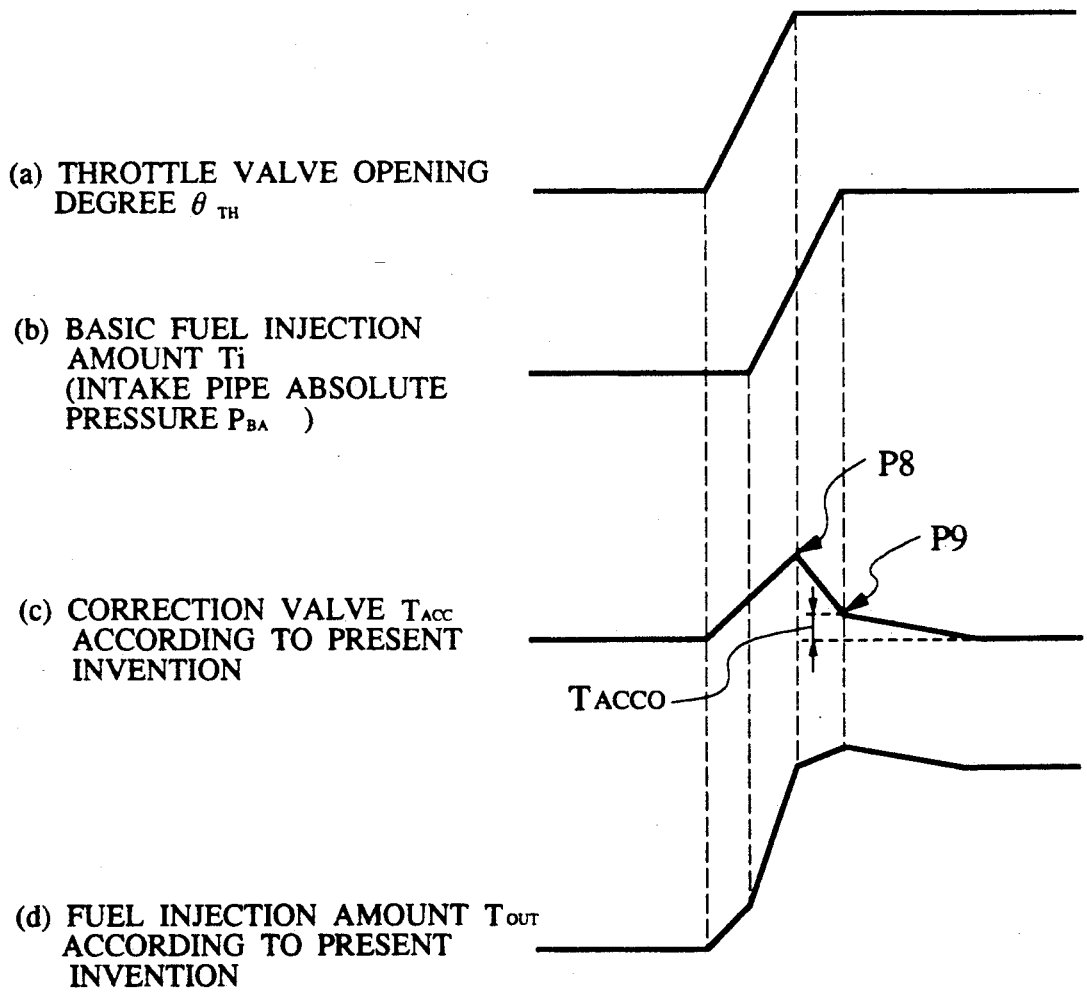
Figure 8:
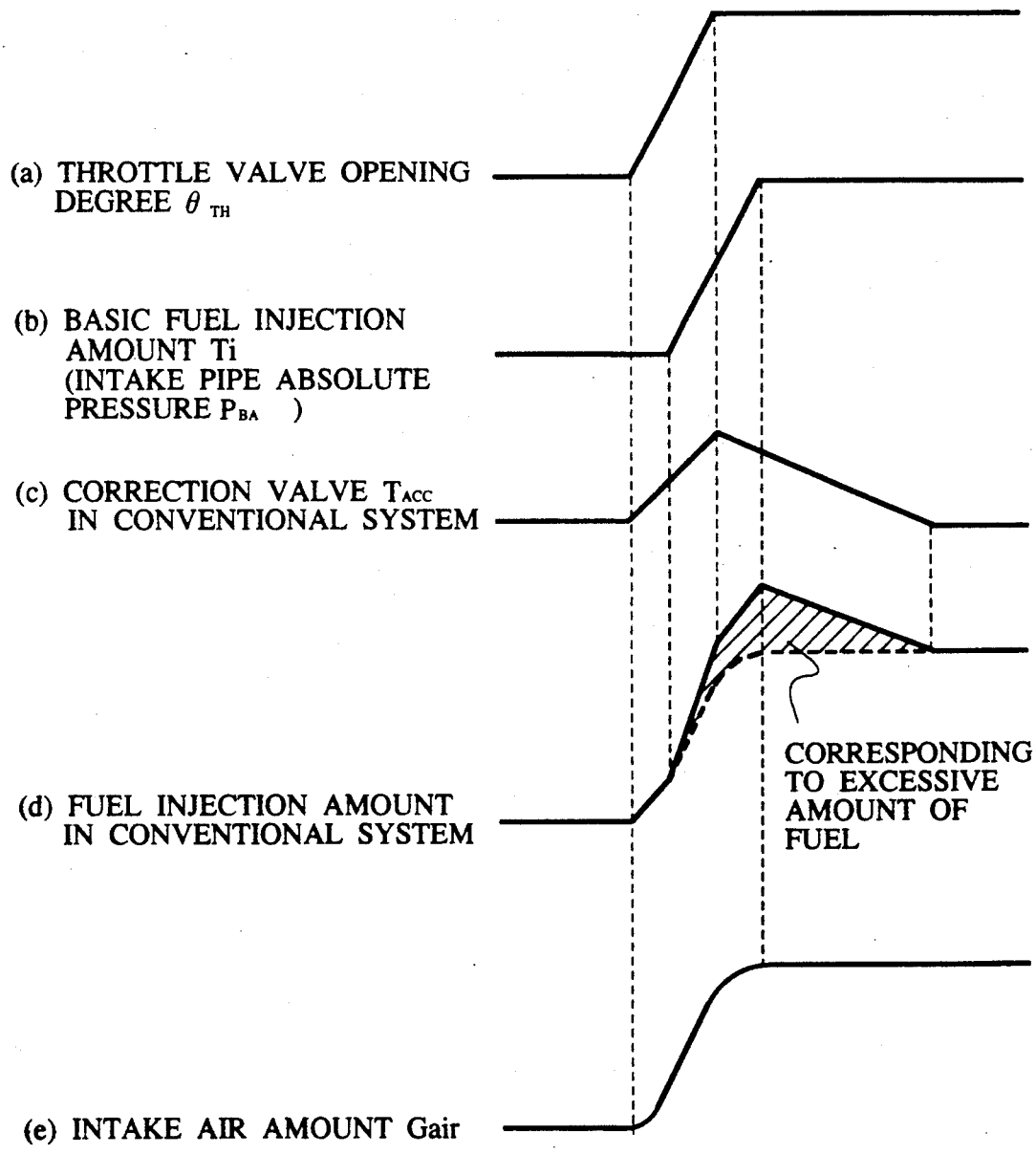

FIGS. (*3a–3c*) are a flowchart of a program for determining a fuel injection period $T_{OUT}$, according to a first embodiment of the invention;

FIG. 4 is a graph showing an $Ne/K_{ACC}$ table stored in an ROM 507 of the ECU;

FIGS. (*5a–5c*) are flowchart of a program for determining the fuel injection period TOUT, according to a second embodiment of the invention;

FIGS. 6(*a–d*) is a timing chart showing changes in an accelerating fuel increment $T_{ACC}$ and a fuel injection amount $T_{OUT}$, wherein the values of $T_{ACC}$ and $T_{OUT}$ are determined by the program of FIG. 3;

FIGS. 7(*a–d*) is a timing chart similar to FIG. 6, wherein the values of $T_{ACC}$ and $T_{OUT}$ are determined by the program of FIG. 5; and FIGS. 8(*a–e*) is a timing chart showing changes in the accelerating fuel increment $T_{ACC}$ and the fuel injection amount $T_{OUT}$, wherein the values of $T_{ACC}$ and $T_{OUT}$ are determined by the conventional method;

DETAILED DESCRIPTION

The invention will now be described in detail with reference to the drawings showing embodiments thereof.

Figure 1:
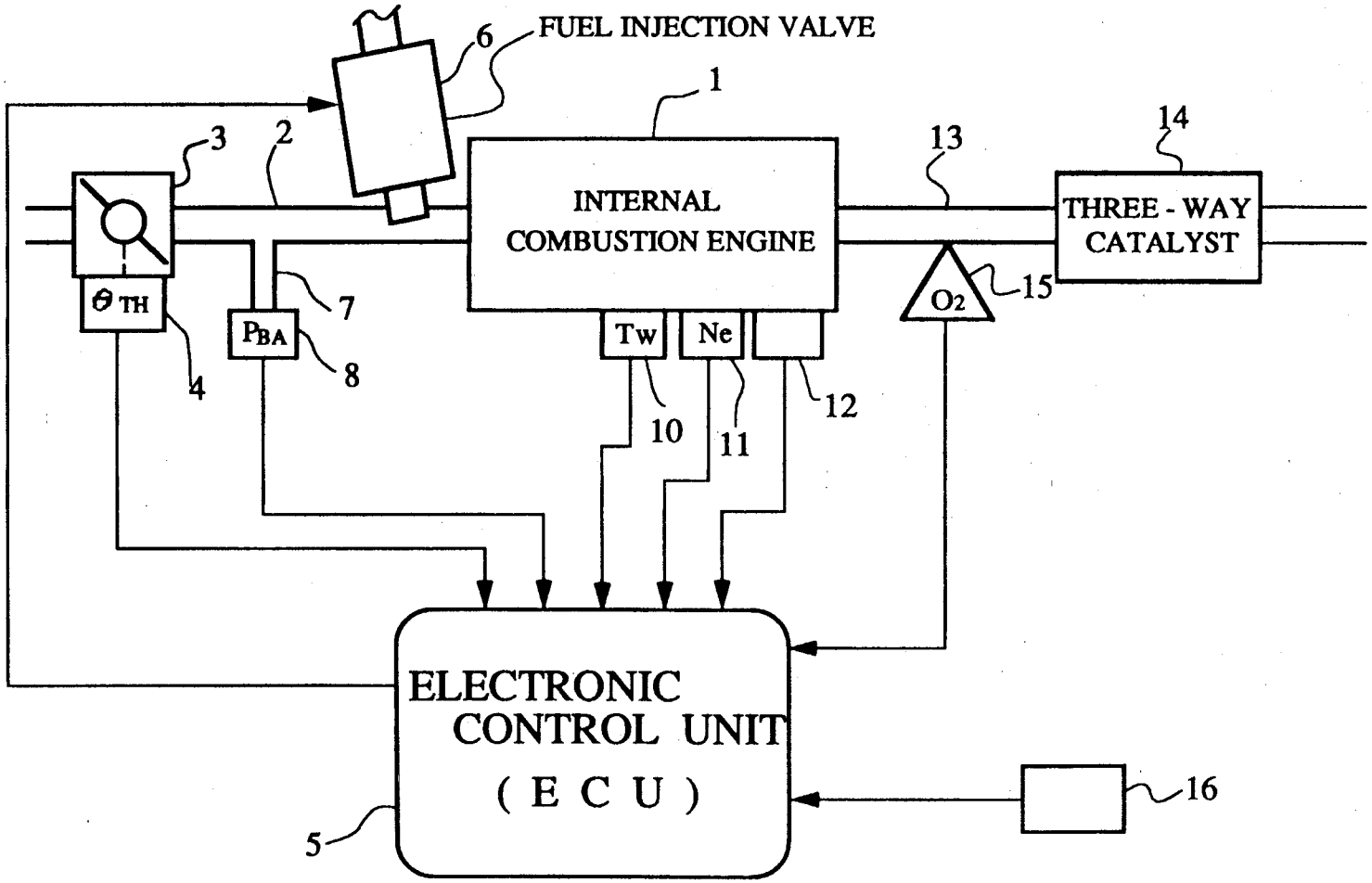
FIG. 1 is a block diagram illustrating the whole arrangement of a fuel supply control system for an internal combustion engine according to the invention.

Referring first to FIG. 1, there is schematically illustrated the whole arrangement of a fuel supply control system according to the embodiment of the invention. In FIG. 1, reference numeral 1 designates an internal combustion engine which may be a four-cylinder type, and to which is connected an intake pipe 2 having a throttle valve 5 arranged therein. A throttle valve opening sensor 4 is connected to the throttle valve 3, which senses the opening degree of the throttle valve 3 and supplies an electric signal representing the sensed opening degree to an electronic control unit (hereinafter referred to as "the ECU") 5.

Fuel injection valves 6 are each arranged in the intake pipe 2 at a location slightly upstream of a corresponding intake valve, not shown, and between the engine 1 and the throttle valve 3, for each of engine cylinders. The fuel injection valves 6 are connected to a fuel pump, not shown, and also electrically connected to the ECU 5 to be supplied with driving signals therefrom, to have their valve opening periods controlled thereby.

An absolute pressure ($P_{BA}$) sensor 8 for detecting absolute pressure $P_{BA}$ within the intake pipe 2 is connected through a pipe 7 to the interior of the intake pipe 2 at a location slightly downstream of the throttle valve 3. The $P_{BA}$ sensor 8 supplies an electric signal representing the detected absolute pressure $P_{BA}$ to the ECU 5.

An engine coolant temperature ($T_W$) sensor 10, which may be formed of a thermistor or the like, is mounted in the cylinder block of the engine 1 in a manner embedded in the peripheral wall of an engine cylinder having its interior filled with coolant, to detect engine coolant temperature $T_W$ and supply an electric signal indicative of the detected engine coolant temperature to the ECU 5. An engine rotational speed (Ne) sensor 11 is arranged in facing relation to a camshaft or a crankshaft of the engine, neither of which is shown. The Ne sensor 11 is adapted to generate a pulse of a top-dead-center position (TDC) signal (hereinafter referred to as "the TDC signal") at one of predetermined crank angles of the engine whenever the engine crankshaft rotates through 180 degrees. Pulses generated by the Ne sensor 11 are supplied to the ECU 5.

A three-way catalyst 14 is arranged in an exhaust pipe 13 extending from the cylinder block of the engine 1 for purifying ingredients HC, CO, and NOx contained in the exhaust gases. An $O_2$ sensor 15 is inserted in the exhaust pipe 13 at a location upstream of the three-way catalyst 14 for detecting the concentration of oxygen ($O_2$) contained in the exhaust gases and supplying an electric signal indicative of the detected oxygen concentration to the ECU 5. Further connected to the ECU 5 are other various sensors 16 for detecting other engine operating parameters and supplying respective electric signals to the ECU 5.

The ECU 5 operates in response to engine operating parameter signals supplied from the above-stated sensors 4, 8, 10, 11, 15, and 16, to determine engine operating conditions such as an accelerating condition, a post-acceleration condition, and a decelerating condition, and then to calculate the fuel injection period $T_{OUT}$ for which each fuel injection valve 6 should be opened in accordance with the determined operating conditions of the engine and in synchronism with generation of pulses of the TDC signal, by the use of the following equation (1):

$$T_{OUT}=Ti\times K_1+T_{ACC}\times K_2+K_3 \quad (1)$$

where Ti represents a basic value of the valve opening period for the fuel injection valve 6, which is determined from the engine rotational speed Ne and the intake pipe absolute pressure $P_{BA}$, for example. $T_{ACC}$ represents a correction variable (accelerating fuel increment) for increasing the fuel amount upon acceleration of the engine (hereinafter merely referred to as "the correction value"), which is determined by a program of FIG. 3 for determining the fuel injection time period $T_{OUT}$, hereinafter described.

$K_1$, $K_2$, and $K_3$ are other correction variables calculated on the basis of engine operating parameters by using respective predetermined arithmetic expressions or maps, to such values as to optimize operating characteristics of the engine such as startability, exhaust emission characteristics, fuel consumption, and accelerability.

The ECU 5 supplies a driving signal to each fuel injection valve 6 to open same over the fuel injection period $T_{OUT}$ calculated as above.

Figure 2:
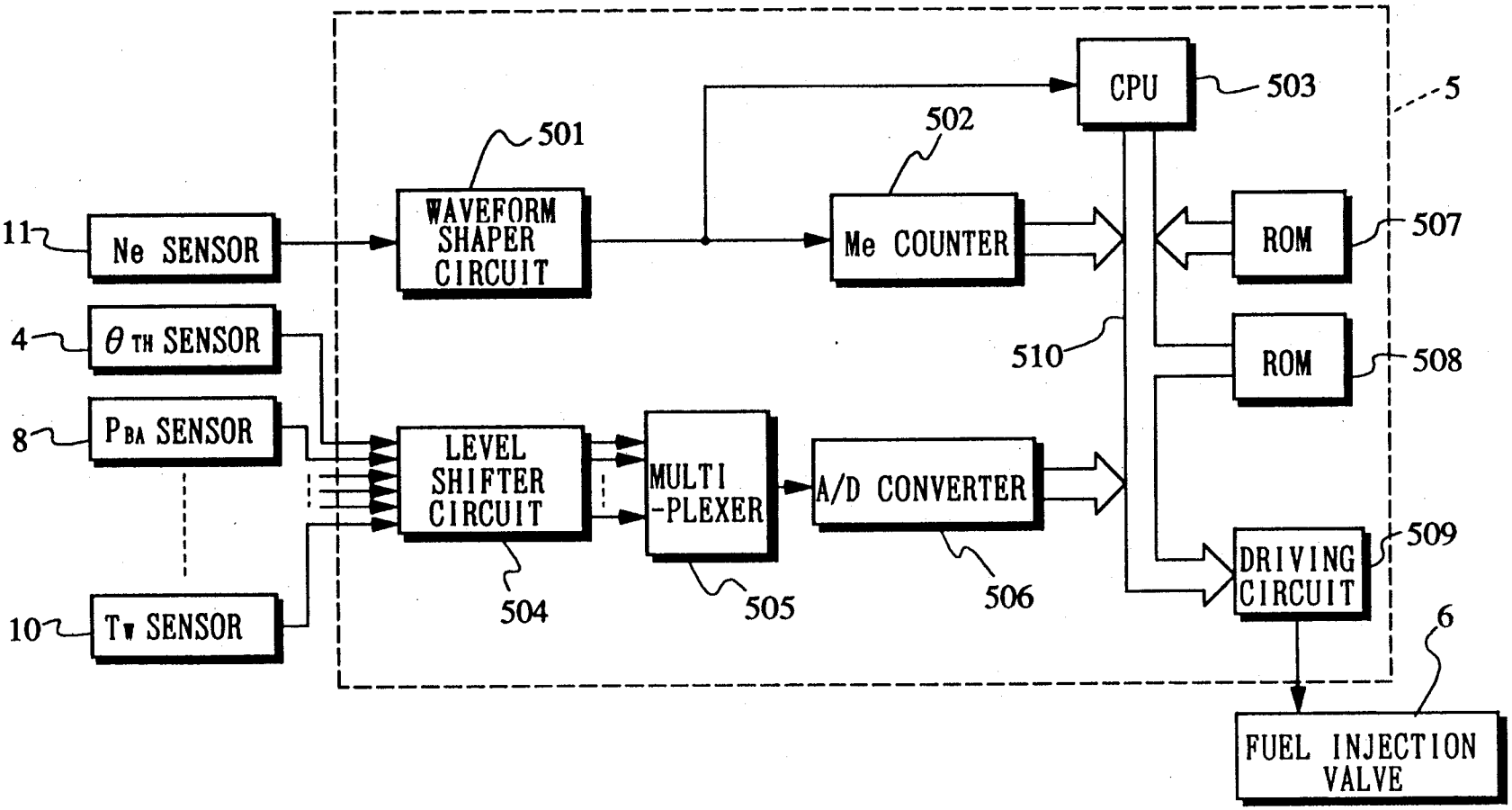
FIG. 2 is a block diagram illustrating the internal arrangement of an electronic control unit (ECU) appearing in FIG. 1.

FIG. 2 shows a circuit configuration inside the ECU 5 in FIG. 1. An output signal from the Ne sensor 11 in FIG. 1 is applied to a waveform shaper 501 wherein it has its pulse waveform shaped, and supplied as the TDC signal to a central processing unit (hereinafter referred to as "the CPU") 503. The TDC signal is supplied to an Me value counter 502, as well. The Me counter 502 counts the interval of time between an immediately preceding pulse of the TDC signal from the Ne sensor 11 and a present pulse of same. Therefore, its counted value Me corresponds to the reciprocal of the actual engine rotational speed Ne. The Me value counter 502 supplies the counted value Me to the CUP 502 via a data bus 510.

Respective output signals from the throttle valve opening ($\theta_{TH}$) sensor 4, the absolute pressure ($P_{BA}$) sensor 8, the engine coolant temperature ($T_W$) sensor 9, all appearing in FIG. 1, and other sensors have their output voltage levels shifted to a predetermined voltage level by a level shifter circuit 504 and successively applied to an analog-to-digital converter 506 through a multiplexer 505.

Further connected to the CPU 503 via the data bus 510 are a read-only memory (hereinafter called "the ROM") 507, a random access memory (hereinafter called "the RAM") 508 and a driving circuit 509. The RAM 508 temporarily stores various calculated values from the CPU 503, while the ROM 507 stores control programs to be executed within the CPU 503, a Ti map for reading the basic value Ti of the fuel injection period $T_{OUT}$ in accordance with the intake pipe absolute pressure $P_{BA}$ and the engine rotational speed, and other tables, such as an $Ne/K_{ACC}$ table, an $Ne/N_{ACC}$ table, an Ne/Kn table, and $\eta_{PACC}/K_{PACC}$ table, hereinafter referred to. The CPU 503 executes a fuel supply control program stored in the ROM 507 to calculate the fuel injection period $T_{OUT}$ for the fuel injection valves 6 in response to the various engine operating parameter signals, and supplies the calculated period value to the driving circuit 509 through the data bus 510. The driving circuit 509 supplies driving signals corresponding to the above calculated $T_{OUT}$ value to the fuel injection valves 6 to drive same.

FIG. 3 shows a flowchart of a program for determining the fuel injection period $T_{OUT}$ according to a first embodiment of the invention. This program is executed upon generation of each pulse of the TDC signal and in synchronism therewith.

First, at a step 301, a basic value Ti of the fuel injection period $T_{OUT}$ is read from the Ti map stored in the ROM 507, in accordance with the engine rotational speed Ne and the intake pipe absolute pressure $P_{BA}$. Then, the correction variables $K_1$, $K_2$, and $K_3$ are calculated based on respective parameter signals from the various sensors, by the use of respective predetermined expressions and maps, at a step 302.

At steps 303 to 305, it is determined whether or not the engine is in a predetermined accelerating condition wherein accelerating fuel increase should be effected. At the step 303, it is determined whether or not the engine rotational speed Ne falls within a range between a predetermined lower limit value $N_{ACCL}$ (e.g. 500 rpm), and a predetermined upper limit value $N_{ACCH}$ (e.g. 6,000 rpm). The predetermined upper and lower limit values $N_{ACCL}$, $N_{ACCH}$ each may comprise two values, i.e. a smaller value and a larger value, so that the respective larger values of $N_{ACCL}$ and $N_{ACCH}$ are applied when the engine rotational speed Ne increases toward the larger values, whereas the respective smaller values of $N_{ACCL}$ and $N_{ACCH}$ are applied when the engine rotational speed Ne decreases toward the smaller values.

At the step 304, it is determined whether or not a control variable $\eta_{ACC}$ is smaller than a predetermined value $N_{ACC}$. The predetermined value $N_{ACC}$ is read from the $Ne/N_{ACC}$ table stored in the ROM 507, by background processing. The $Ne/N_{ACC}$ table is set such that it increases with increase in the engine rotational speed Ne. The control variable $\eta_{ACC}$ is increased by 1 upon generation of each TDC signal pulse, until it reaches the value $N_{ACC}$, at a step 315, hereinafter referred to, immediately after the engine has entered the predetermined accelerating condition.

It is then determined at the step 305 whether or not the difference $\Delta\theta_{TH}$ between the throttle valve opening degree $\theta_{TH}$ in the present loop and the throttle valve opening degree $\theta_{TH-1}$ in the last loop (i.e. the rate of change $\Delta\theta_{TH}=\theta_{TH}-\theta_{TH-1}$) is larger than a predetermined value $\Delta ThG+$ (e.g. 0.5 degrees) for discriminating the predetermined accelerating condition of the engine.

If all the answers to the questions of the steps 303, 304, and 305 are affirmative or Yes, that is, if the engine rotational speed Ne falls within the range defined between the predetermined lower and upper limit values $N_{ACCL}$ and $N_{ACCH}$, TDC signal pulses equal in number to $N_{ACC}$ have not been generated after the engine entered the predetermined accelerating condition, and the rate of change $\Delta\theta_{TH}$ in the throttle valve opening degree $\theta_{TH}$ is larger than the predetermined value $\Delta ThG^+$, it is judged that the engine is in the predetermined accelerating condition, and then the program proceeds to steps 306 et seq. for carrying out accelerating fuel increase.

On the other hand, if any of the answers to the questions of the steps 303, 304, and 305 is negative or No, that is, if the engine rotational speed Ne falls out of the range between the predetermined lower and upper limit values $N_{ACCL}$, $N_{ACCH}$, TDC signal pulses equal in number to $N_{ACC}$ have been generated after the engine entered the predetermined accelerating condition, or the rate of change $\Delta\theta_{TH}$ in the throttle valve opening degree $\theta_{TH}$ is smaller than the predetermined value $\Delta\theta_{ThG}^+$, it is judged that the engine is not in the predetermined accelerating condition, and then the program proceeds to a step 318 for carrying out post-accelerating operation or deceleration operation.

At a step 306, a coefficient $K_{ACC}$, which is applied to a step 310, hereinafter referred to, is read from the Ne/-$K_{ACC}$ table stored in the ROM 507, in accordance with the engine rotational speed Ne. FIG. 4 shows the Ne/-$K_{ACC}$ table in which values $K_{ACC1}-K_{ACC4}$ of the coefficient $K_{ACC}$ are provided, respectively, for engine rotational speed values Ne1—Ne4. When the engine rotational speed Ne falls between two values of Ne1—Ne4, the value of $K_{ACC}$ may be determined by an interpolation method.

Then, it is determined at a step 307 whether or not the control variable $\eta_{ACC}$ is equal to 0. When $\eta_{ACC}=0$, it means that the engine has just entered the predetermined accelerating condition in which accelerating fuel increase should be made, immediately before the present loop, because the control variable $\eta_{ACC}$ is always set to 0 at a step 324, hereinafter referred to, so long as the engine is not in the predetermined accelerating condition. If the answer to the question of the step 307 is affirmative or Yes, the value $\theta_{TH(n-1)}$ of the throttle valve opening degree $\theta_{TH}$ obtained in the last loop is set to an initial $\theta_{TH}$ value $T_{hTACCL}$ at acceleration, and the value $P_{BA(n-1)}$ of the intake pipe absolute pressure $P_{BA}$ obtained in the last loop is set to an initial $P_{BA}$ value $P_{BACCL}$ at acceleration, at a step 308. On the other hand, if the answer to the question of the step 307 is negative or No, that is, if the value of $\eta_{ACC}$ is 1, 2, . . . , or $N_{ACC-1}$, the program skips over the step 308 to a step 309. The initial $\theta_{TH}$ value $T_{hTACCL}$ corresponds to a value at P1 in (*a*) of FIG. 6, whereas the initial $P_{BA}$ value $P_{BACCLL}$ corresponds to a value at P2 in (*b*) of the same figure. These initial values $T_{hTACCL}$ and $P_{BACCLL}$ are updated and stored solely when the engine has entered for the first time the predetermined accelerating condition wherein accelerating fuel increase should be made, instead of being updated upon generation of each TDC signal pulse.

Then, at the step 309, the initial $\theta_{TH}$ value $T_{hTACCL}$ is subtracted from the throttle valve opening degree $\theta_{TH}$ obtained in the present loop and the subtracted $\theta_{TH}$ value is set to the change amount $D_{ThACCL}$ in the throttle valve opening $\theta_{TH}$, while the initial $P_{BA}$ value $P_{BACCL}$ is subtracted from the intake pipe absolute pressure $P_{BA}$ obtained in the present and the subtracted $P_{BA}$ value loop is set to the change amount $D_{PBACC}$ in the intake pipe absolute pressure $P_{BA}$. When the change amount $D_{PBACC}$ assumes a negative value, it is set to 0.

Then, the correction value $T_{ACC}$ for accelerating fuel increase is calculated based on the coefficient $K_{ACC}$ obtained at the step 306, and the change amounts $D_{ThACC}$ and $D_{PBACC}$ obtained at the step 309, by the use of the following equation (2), at the step 310:

$$T_{ACC}=K_{ACC}\times D_{ThACC}-Kn\times D_{PBACC} \quad (2)$$

where Kn is a coefficient which is read from the Ne/Kn table stored in the ROM 507, in accordance with the engine rotational speed Ne.

In (*c*) of FIG. 6, the correction value $T_{ACC}$ thus calculated by the equation (2) is shown as an example by the solid line between P3 and P5, whereas the conventional correction value $T_{ACC}$ is shown by the broken line. The correction value $T_{ACC}$ according to the present invention is decreased between P4 and P5 with increase in the intake pipe absolute pressure $P_{BA}$, by an amount corresponding to the change amount $D_{PBACC}$ in the intake pipe absolute pressure $P_{BA}$. Thus, according to the invention, the acceleration fuel increase amount is less affected by increase in the intake pipe absolute pressure $P_{BA}$ as compared with the conventional correction value $T_{ACC}$, thereby making it possible to make the amount of fuel better suited for the intake air amount $G_{air}$ supplied to the engine.

The calculated correction value $T_{ACC}$ is then compared with a predetermined value $T_{ACCG}$ defining an upper limit thereof, at a step 311. If the correction value $T_{ACC}$ is larger than the predetermined value $T_{ACCG}$, the former is set to the latter, at a step 312, and then the program proceeds to a step 313, wherein the correction value $T_{ACC}$ is compared with a predetermined value $T_{ACC0}$ defining a lower limit thereof. If the correction value $T_{ACC}$ is smaller than the predetermined value $T_{ACC0}$, the program proceeds to a step 314, wherein the former is set to the latter. After limit checking of the correction value $T_{ACC}$ as described above, the program proceeds to the step 315.

At the step 315, the control variable $\eta_{ACC}$ is increased by 1, and then the post-acceleration control variable $\eta_{PACC}$ is set to 0, at a step 316, followed by the program proceeding to a step 317.

At the step 317, the fuel injection period $T_{OUT}$ of the fuel injection valve 6 is calculated from the basic value Ti determined at the step 301, the correction variables $K_1$, $K_2$, and $K_3$ determined at the step 302, and the correction value $T_{ACC}$ calculated at the step 310 and subjected to limit checking at the steps 311 to 314, by the use of the equation (1), followed by terminating the program.

The fuel injection period $T_{OUT}$ thus obtained is shown as an example in (d) of FIG. 6.

At the step 318, on the other hand, it is determined whether or not the rate of change $\Delta\theta_{TH}$ in the throttle valve opening degree $\theta_{TH}$ is smaller than a predetermined value $\Delta ThG^-$ (e.g. −0.5 degrees) defining a predetermined decelerating condition of the engine. If the answer is negative or No, that is, if the engine rotational speed falls out of the range between the predetermined values $N_{ACCH}$, $N_{ACCL}$, or TDC signal pulses equal in number to $N_{ACC}$ have been generated after the engine entered the predetermined accelerating condition, or the relationship $\Delta\theta_{TH}>\Delta ThG^+$ does not hold and accordingly the engine is not in the predetermined accelerating condition, and at the same time $\Delta\theta_{TH}<\Delta ThG^-$ does not hold and accordingly the engine is not in the predetermined decelerating condition, the program proceeds to a step 319 for carrying out the post-acceleration operation.

On the other hand, if the answer to the question of the step 318 is affirmative or Yes, it is judged that the engine is in the predetermined decelerating condition, and then the program proceeds to a step 325 et seq. for carrying out the deceleration operation.

At the step 319, it is determined whether or not the post-acceleration control variable $\eta_{PACC}$ is equal to 4. The post-acceleration control variable $\eta_{PACC}$ is set to 0 at the step 316, so that the former assumes 0 immediately when the engine has entered the predetermined post-acceleration condition wherein post-acceleration operation should be carried out at steps 321 to 323, hereinafter described, and increased by 1 at the step 323 whenever it is executed until it reaches 4. The maximum $\eta_{PACC}$ number is not limited to 4, but may be set at another number.

At a step 320, it is determined whether or not the engine coolant temperature $T_W$ sensed by the engine coolant temperature sensor 10 is lower than a predetermined value $T_{WL}$ (e.g. 60° C.).

If the answer to the question of the step 319 is affirmative or Yes, that is, if a time period corresponding to 4 TDC signal pulses for which post-acceleration operation should be carried out has elapsed, or if the answer to the question of the step 320 is negative or No, that is, if the engine has been warmed up to such an extent that there is no possibility of occurrence of a sudden change in engine output torque when acceleration fuel increase is terminated immediately after the lapse of the time period for which the accelerating fuel increase is carried out, the program proceeds to a step 326, wherein the correction value $T_{ACC}$ is immediately set to 0.

On the other hand, if the answer to the question of the step 319 is negative or No, and at the same time the answer to the question of the step 320 is affirmative or Yes, in other wards, if the post-acceleration operation is being carried out, and if there is a possibility of occurrence of a sudden change in the engine output torque when the accelerating fuel increase is immediately terminated, a value of the coefficient $K_{PACC}$ is read from the $\eta_{PACC}/K_{PACC}$ table stored in the ROM 507, in accordance with the post-acceleration control variable $\eta_{PACC}$, at the step 321. The coefficient $K_{PACC}$ comprises predetermined values which are selectively read such that the coefficient $K_{PACC}$ progressively decreases with increase in the post-acceleration control variable $\eta_{PACC}$. The rate of change in the coefficient value may be constant, e.g. it may be progressively decreased at a constant rate of ½, such at $K_{PACC0}=0.5$ when $\eta_{PACC}=0$, $K_{PACC1}=0.25$ when $\eta_{PACC}=1$, $K_{PACC2}=0.125$ when $\eta_{PACC}=3$, and $K_{PACC3}=0.0675$ when $\eta_{PACC}=3$.

At a step 322, the correction value $T_{ACC}$ is determined by multiplying the stored value $T_{ACC0}$ thereof obtained immediately before the lapse of the time period of accelerating fuel increase by the coefficient $K_{PACC}$ read at the step 321. The determined correction value $T_{ACC}$ corresponds to a value at P5 indicated by the solid line in (c) of FIG. 6. That is, the correction value $T_{ACC}$ applied for post-acceleration operation is progressively decreased from the initial value $T_{ACC0}$ obtained immediately before the lapse of the time period of accelerating fuel increase, as shown by the solid line in (c) of FIG. 6. In this manner, after the time period of accelerating fuel increase has elapsed, so long as the engine operation satisfies a predetermined condition and at the same time the engine coolant temperature $T_W$ is below the predetermined value $T_{WL}$, the correction value $T_{ACC}$ is progressively decreased without immediate termination of the accelerating fuel increase, thereby preventing sudden leaning of the mixture.

More specifically, toward the end of the time period of accelerating fuel increase, the correction value $T_{ACC}$ is rather decreased to the value $T_{ACC}$ as the intake pipe absolute pressure $P_{BA}$ increases between P4 and P5, as shown by the solid line in (c) of FIG. 6. After the accelerating fuel increase, the correction value $T_{ACC}$ is progressively decreased from the initial value $T_{ACC0}$ assumed at P5 in (c) of FIG. 6. Consequently, the correction value $T_{ACC}$ according to the invention is smaller than the conventional correction value $T_{ACC}$ by an amount corresponding to the hatched area in (c) of FIG. 6. Accordingly, the fuel injection amount (fuel injection period) $T_{OUT}$ corrected by the correction value $T_{ACC}$ assumes a curve as shown by the solid line in (c) of FIG. 6, which is better suited for the intake air amount $G_{air}$ shown in (e) of FIG. 8, resulting in improvements in exhaust emission characteristics, driveability, fuel consumption, etc.

Referring again to FIG. 3, at the step 323, the post-acceleration control variable $\eta_{PACC}$ is increased by 1, and the acceleration control variable $\eta_{ACC}$ is set to 0 at a step 324, followed by the program proceeding to the step 317.

If the answer to the question of the step 318 is affirmative or Yes, it is judged that the engine is in the predetermined decelerating condition, and then the post-acceleration control variable $\eta_{PACC}$ is set to 4, at a step 325, in order to inhibit the post-acceleration operation at the steps 320 to 323 from being executed upon generation of the next TDC signal pulse, followed by the program proceeding to a step 326 to immediately set the correction value $T_{ACC}$ to 0.

FIG. 5 shows a flowchart of a program for determining the fuel injection period $T_{OUT}$ according to a second embodiment of the invention. This program is executed upon generation of each TDC signal pulse and in synchronism therewith.

Steps 501 to 507 of the present program are identical, respectively, with the steps 301 to 307 of the FIG. 3 program, described hereinbefore, and description thereof is therefore omitted.

If the answer to the question of the step 507 is affirmative or Yes, the program proceeds to a step 508, wherein the throttle valve opening degree $\theta_{TH(n-1)}$ obtained in the last loop is set to the initial value $T_{hTACCL}$ of the throttle valve opening degree $\theta_{TH}$. On the other hand, if the answer to the question of the step 507 is negative or No, that is, if the value of $\eta_{ACC}$ is 1, 2, . . . , or $N_{ACC-1}$, the program skips over the step 508 to a step 509.

At the step 509, a value obtained by subtracting the initial value $T_{hTACCL}$ from the throttle valve opening degree $\theta_{TH}$ obtained in the present loop is set to the change amount $D_{ThACC}$ in the throttle valve opening degree.

The change amount $D_{ThACC}$ is then multiplied by the coefficient $K_{ACC}$ obtained at the step 506 to determine the correction value $T_{ACC}$, i.e. $T_{ACC}=K_{ACC}\times D_{ThACC}$, at a step 510.

Then, the program proceeds to a step 511, wherein the correction value $T_{ACC}$ thus determined at the step 510 is compared with the predetermined value $T_{ACCG}$ defining the upper limit thereof. If the answer is affirmative or Yes, that is, if the correction value $T_{ACC}$ is larger than the predetermined value $T_{ACCG}$, the former is set to the latter, at a step 512. The correction value $T_{ACC}$ is also compared with the predetermined value $T_{ACC0}$ defining the lower limit thereof, at a step 513. If the answer is affirmative or Yes, that is, if the correction value $T_{ACC}$ is smaller than the predetermined value $T_{ACC0}$, the former is set to the latter, at a step 514. After limit checking of the correction value $T_{ACC}$ as described above, the program proceeds to a step 515, wherein the control variable $\eta_{ACC}$ is increased by 1, followed by the program proceeding to a step 516.

At the step 516, the fuel injection period $T_{OUT}$ for which the fuel injection valve 3 should be opened, is calculated based on the basic value Ti of the fuel injection period $T_{OUT}$ determined at the step 501, correction variables $K_1$, $K_2$, and $K_3$ determined at the step 502, and the correction value $T_{ACC}$ determined at the step 510 and subjected to limit checking at the steps 511 to 514, by the use of the equation (1), followed by terminating the program.

On the other hand, at a step 517, it is determined whether or not the rate of change $\Delta\theta_{TH}$ in the throttle valve opening degree $\theta_{TH}$ is smaller than the predetermined value $\Delta ThG^-$ (e.g. $-0.5$ degrees) defining the predetermined decelerating condition. If the engine rotational speed Ne falls out of the range between the predetermined upper and lower values $N_{ACCH}$, $N_{ACCL}$, TDC signal pulses equal in number to $N_{ACC}$ have been generated after the engine entered the predetermined accelerating condition, or the relationship $\Delta\theta_{TH} > \Delta ThG^+$ is not satisfied and accordingly the engine is not in the predetermined accelerating condition, and at the same time the answer to the question of the step 517 is negative or No, that is, if the engine is not in the predetermined decelerating condition, i.e. the relationship $\Delta\theta_{TH} < \Delta ThG^-$ is not satisfied, the program proceeds to a step 518 for carrying out post-acceleration operation. On the other hand, if the answer to the question of the step 517 is affirmative or Yes, it is judged that the engine is in the predetermined decelerating condition, and accordingly the program proceeds to a step 525 for carrying out decelerating operation.

At the step 518, it is determined whether or not the difference $\Delta P_{BA}$ between the intake pipe absolute pressure $P_{BAn}$ obtained in the present loop and the intake pipe absolute pressure $P_{BAn-1}$ obtained in the last loop, i.e. $\Delta P_{BA} = P_{BAn} - P_{BAn-1}$, is larger than a predetermined value $\Delta P_{BACCG}$. If the answer is affirmative or Yes, that is, if the intake pipe absolute pressure $P_{BA}$ is increasing at a rate greater than a predetermined rate, the program proceeds to a step 519, wherein the correction value $T_{ACC}$ is calculated by subtracting the product of the rate of change $\Delta P_{BA}$ in the intake pipe absolute pressure $P_{BA}$ and the coefficient Kn from the correction value $T_{ACC}$ obtained in the last loop, by the use of the following equation (3):

$$T_{ACC} - \Delta P_{BA} \times Kn \quad (3)$$

where the coefficient Kn is read from the Ne/Kn table stored in the ROM 507, in accordance with the engine rotational speed Ne.

Thus, the correction value $T_{ACC}$ is decreased as the intake pipe absolute pressure $P_{BA}$ increases, as shown between P8 and P9 in (c) of FIG. 7.

The correction value $T_{ACC}$ calculated at the step 519 is compared with the predetermined value $T_{ACC0}$ defining the lower limit thereof, at a step 520. If the correction value $T_{ACC}$ is larger than the predetermined value $T_{ACC0}$, it is determined that the correction value $T_{ACC}$ per se should be applied as the correction value $T_{ACC}$ in the present loop, followed by the program proceeding to a step 521. At the step 521, the control variable $\eta_{ACC}$ is set to 0, and then the program proceeds to the step 516. On the other hand, if the answer to the question of the step 520 is negative or No, that is, if the correction value $T_{ACC}$ is below the predetermined value $T_{ACC0}$, the correction value $T_{ACC}$ is set to the predetermined value $T_{ACC0}$, at a step 522, and then the program proceeds to a step 523, wherein a predetermined value $T_{PACC}$ is subtracted from the set correction value $T_{ACC}$. At the next step 524, it is determined whether or not the correction value $T_{ACC}$ is larger than 0. If the answer is affirmative or Yes, the correction value $T_{ACC}$ per se is applied in the present loop, and then the program proceeds to the step 521. On the other hand, if the correction value $T_{ACC}$ is smaller than 0, the program proceeds to a step 525, wherein the correction value $T_{ACC}$ to be applied in the present loop is set to 0. Thus, after the correction value $T_{ACC}$ becomes below the predetermined value $T_{ACC0}$, the correction value $T_{ACC}$ is subtracted by the predetermined value $T_{ACC0}$ whenever a TDC signal pulse is generated, and held at 0 when and after the correction value $T_{ACC}$ is decreased to 0. However, in the case where the step 522 is executed whenever a TDC signal pulse is generated, the correction value $T_{ACC}$ cannot be decreased to 0 immediately after the correction value $T_{ACC}$ is set to $T_{ACC0}$. That is, the steps 523, 524, and 525 are usually executed when the answer to the question of the step 518 is negative.

If the answer to the question of the step 518 is negative or No, that is, if the intake pipe absolute pressure $P_{BA}$ is not increasing at a rate greater than the predetermined value $DP_{BACCG}$, it is judged that there is almost no possibility that the change (increase) in the intake pipe absolute pressure $P_{BA}$ has an effect upon the fuel injection period $T_{OUT}$, and accordingly the program proceeds to the step 523, wherein the correction value $T_{ACC}$ is determined by subtracting the predetermined value $T_{PACC}$ from the correction value $T_{ACC}$ obtained in the last loop.

In this way, after acceleration, the correction value $T_{ACC}$ is progressively decreased as indicated by the lines between P8 and P9, and at and after P9. As a consequence, the fuel injection period (fuel injection amount) $T_{OUT}$ corrected by the correction value $T_{ACC}$ changes along the curve in (d) of FIG. 7, thereby being well appropriate to the amount of intake air $G_{air}$. Therefore, supply of an excessive amount of fuel can be prevented after acceleration, resulting in improvements in exhaust emission characteristics, drivability, fuel consumption, etc.

If the answer to the question of the step 517 is affirmative or Yes, that is, if the engine is decelerating, the program proceeds to the step 525, wherein the correction value $T_{ACC}$ is immediately set to 0.

As described above, in the first embodiment shown in FIG. 3, the correction value $T_{ACC}$ is determined based on the change amount $D_{PACC}$ in the intake pipe absolute pressure $P_{BA}$, at the steps 308 to 310, whereas in the second embodiment shown in FIG. 5, the correction value $T_{ACC}$ is determined based on the rate of change $\Delta P_{BA}$ in the intake pipe absolute pressure $P_{BA}$, at the steps 518 to 519. However, the amount of intake air $Q_A$ detected by a known airflow meter may be employed in place of the intake pipe absolute pressure $P_{BA}$, because the former varies in proportion to the basic value Ti of the fuel injection period, like the intake pipe absolute pressure $P_{BA}$. Further, the basic value Ti of the fuel injection period may also be used in place of the intake pipe absolute pressure $P_{BA}$.

What is claimed is:

1. In a fuel supply control system for an internal combustion engine having an intake pipe, and a throttle valve arranged in said intake pipe, wherein a basic value of a fuel amount to be supplied to said engine is determined based on a load on said engine, and the determined basic value of said fuel amount is corrected by a correction value for increasing said fuel amount during and/or after acceleration of said engine, said correction value being determined based on a change in the opening degree of said throttle valve, the improvement comprising correction value decreasing means for decreasing said correction value with increase in the magnitude of said load on said engine.

2. A fuel supply control system as claimed in claim 1, wherein said correction value decreasing means decreases said correction value with increase in absolute pressure within said intake pipe.

3. A fuel supply control system as claimed in claim 1, wherein said basic value of said fuel amount is determined based on absolute pressure within said intake pipe, said correction value being decreased with increase in said basic value of said fuel amount.

4. In a fuel supply control system for an internal combustion engine having an intake pipe, and a throttle valve arranged in said intake pipe, the system including basic value determining means for determining a basic value of a fuel amount to be supplied to said engine, based on a load on said engine, acceleration determining means for detecting the opening degree of said throttle valve and determining whether or not said engine is in a predetermined accelerating condition, based on a change in the opening degree of said throttle valve, correction value determining means for determining a correction value for increasing said fuel amount, based on a change in the opening degree of said throttle valve when said acceleration determining means determines that said engine is in said predetermined accelerating condition, and basic value correcting means for correcting said basic value of said fuel amount by said correction value, the improvement comprising correction value decreasing means for decreasing said correction value with increase in the magnitude of said load on said engine.

5. A fuel supply control system as claimed in claim 4, wherein said correction value decreasing means decreases said correction value at a larger rate as a rate of increase in said load on said engine increases.

6. A fuel supply control system as claimed in claim 4 or 5, wherein said correction value decreasing means decreases said correction value with increase in absolute pressure within said intake pipe.

7. A fuel supply control system as claimed in claim 4 or 5, wherein said basic value of said fuel amount is determined based on absolute pressure within said intake pipe, said correction value decreasing means decreasing said correction value with increase in said basic value of said fuel amount.

8. In a fuel supply control system for an internal combustion engine having an intake pipe, and a throttle valve arranged in said intake pipe, the system including basic value determining means for determining a basic value of a fuel amount to be supplied to said engine, based on a load on said engine, correction value determining means for determining a correction value for increasing said fuel amount, based on a change in the opening degree of said throttle valve, and basic value correcting means for correcting said basic value, based on said correction value determined by said correction value determining means, said correction value determining means including acceleration determining means for detecting the opening degree of said throttle valve and determining whether said engine is in a predetermined accelerating condition or in a post-acceleration condition, based on a change in the opening degree of said throttle valve, acceleration correction value determining means for determining said correction value, based on a change in the opening degree of said throttle valve when said acceleration determining means determines that said engine is in said predetermined accelerating condition, and post-acceleration correction value determining means for progressively decreasing said correction value from a value thereof obtained immediately before termination of said predetermined accelerating condition when said acceleration determining means determines that said engine is in said post-acceleration condition, and decrease rate changing means for changing a decrease rate at which said correction value is progressively decreased by said post-acceleration correction value determining means, the improvement wherein said decrease rate changing means sets said decrease rate based on a change in the magnitude of said load on said engine.

9. A fuel supply control system as claimed in claim 8, wherein said decrease rate changing means sets said decrease rate to a larger rate as a rate of increase in the magnitude of said load on said engine increases.

10. A fuel supply control system as claimed in claim 8 or 9, wherein said correction value decreasing means progressively decreases said correction value at a rate set based on a change in absolute pressure within said intake pipe.

11. A fuel supply control system as claimed is claim 8 or 9, wherein said basic value of said fuel amount is determined based on absolute pressure within said intake pipe, said correction value decreasing means progressively decreasing said correction value at a rate set based on a change in said basic value of said fuel amount.

12. A fuel supply control system as claimed in any of claims 4, 5, 8 and 9, wherein said basic value correction means corrects said basic value of said fuel amount by adding said correction value to said basic value of said fuel amount.

* * * * *